US007875110B2

(12) United States Patent
Klein et al.

(10) Patent No.: US 7,875,110 B2
(45) Date of Patent: Jan. 25, 2011

(54) ELECTROLESS PLATING BATH COMPOSITION AND METHOD OF USE

(75) Inventors: Rita J. Klein, Boise, ID (US); Adam J. Regner, III, Meridian, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 12/706,203

(22) Filed: Feb. 16, 2010

(65) Prior Publication Data

US 2010/0144144 A1 Jun. 10, 2010

Related U.S. Application Data

(62) Division of application No. 11/168,675, filed on Jun. 28, 2005, now Pat. No. 7,686,874.

(51) Int. Cl.
*C23C 18/34* (2006.01)
*B05D 1/18* (2006.01)

(52) U.S. Cl. ..... 106/1.22; 106/1.27; 427/99.5; 427/437; 427/443.1

(58) Field of Classification Search ..... 106/1.22, 106/1.27; 427/96.1, 97.7, 99.5, 437, 443.1
See application file for complete search history.

(56) References Cited

U.S. PATENT DOCUMENTS

| | | | | |
|---|---|---|---|---|
| 3,597,267 | A | 8/1971 | Baudrand et al. | |
| 3,627,545 | A | 12/1971 | Baudrand et al. | |
| 4,072,781 | A | 2/1978 | Shirahata et al. | |
| 5,364,459 | A | 11/1994 | Senda et al. | |
| 5,755,859 | A | 5/1998 | Bruise et al. | |
| 5,925,415 | A | 7/1999 | Fry et al. | |
| 6,146,702 | A | 11/2000 | Zitko | |
| 6,645,567 | B2 | 11/2003 | Chebiam et al. | |
| 6,716,330 | B2 | 4/2004 | Hongo et al. | |
| 6,717,189 | B2 | 4/2004 | Inoue et al. | |
| 7,098,128 | B2 * | 8/2006 | Collins et al. | 438/620 |
| 7,189,626 | B2 * | 3/2007 | Elkins et al. | 438/397 |
| 7,686,874 | B2 * | 3/2010 | Klein et al. | 106/1.22 |
| 2004/0142114 | A1 | 7/2004 | Kong et al. | |
| 2004/0175509 | A1 | 9/2004 | Kolics et al. | |
| 2005/0006339 | A1 | 1/2005 | Mardilovich et al. | |

OTHER PUBLICATIONS

Pearlstein, F. et al., "Electroless Cobalt Deposition from Acid Baths," J. Electrochem. Soc.: Electrochemical Science and Technology, Aug. 1974, vol. 121, No. 8, pp. 1023-1028.
Modern Electroplating, John Wiley & Sons, p. 731, no date available.
Electroless Plating: Fundamentals & Applications. American Electrolpaters and Surface Finishers Society, Inc., p. 486, no date available.
Modern Electroplating, 3rd edition 1974, pp. 718-719.
Electroless plating, Fundamentals and Applications, 1990, p. 318.

* cited by examiner

*Primary Examiner*—Helene Klemanski
(74) *Attorney, Agent, or Firm*—Wells St. John P.S.

(57) ABSTRACT

An electroless plating composition comprising succinic acid, potassium carbonate, a source of cobalt metal ions, a reducing agent, and water is provided. An optional buffering agent may also be included in the composition. The composition may be used to deposit cobalt metal in or on semiconductor substrate surfaces including vias, trenches, and interconnects.

20 Claims, No Drawings

ELECTROLESS PLATING BATH COMPOSITION AND METHOD OF USE

CROSS-REFERENCE TO RELATED APPLICATIONS

This application is a divisional of U.S. patent application Ser. No. 11/168,675 filed Jun. 28, 2005 now U.S. Pat. No. 7,686,874 entitled ELECTROLESS PLATING BATH COMPOSITION AND METHOD OF USE.

BACKGROUND OF THE INVENTION

The present invention relates generally to electroless plating, and more particularly to cobalt electroless plating bath compositions and their use in the fabrication of structures in semiconductor devices.

Electroless plating is a wet chemical plating technique utilized by the semiconductor industry to deposit thin films of metal or metal alloy over a substrate during the fabrication or packaging of semiconductor devices. Electroless plating can be accomplished with relatively low cost tooling and materials as compared to electroplating. Further, electroless plating is selective, provides excellent step coverage, and good filling capabilities, even when filling high aspect ratio trenches and vias. Accordingly, electroless plating is suitable for the construction of submicron feature devices.

Electroless plating is a controlled autocatalytic chemical reduction reaction of aqueous metal or metal alloy ions to a base substrate. That is, the metal or metal alloy being deposited serves to catalyze the reaction. Basically, a device such as a semiconductor structure is placed in an electroless plating bath. The electroless bath typically includes an aqueous solution of metal ions, complexing agents, and reducing agents. The bath may also include stabilizers, various additives, and buffers, as well as rate promoters to speed up or slow down the deposition process. As such, the particular composition of the plating bath typically varies based upon the specific application to account for the desired parameters of the plating process. Unlike conventional electroplating however, no electrical current or power supply, anodes, batteries, or rectifiers are required to perform an electroless plating deposition.

Electroless plating is of interest in the fabrication of semiconductor devices because electroless plating deposition provides a substantially uniform conductive layer that can conformally plate a substrate, even if the substrate has an irregular shape or deep openings. The rate of deposition of the metal layer may also be successfully controlled. The electroless plating process can be controlled to generally avoid plating material buildup up at the edges and corners of the substrate. As such, high aspect ratios, sharp edges, holes, trenches, and vias may all be successfully plated. Electroless deposition thus provides an attractive alternative processing technique when conventional processing such as using physical vapor deposition (PVD) cannot provide satisfactory step coverage. Also, electroless plating layers are virtually nonporous, which allows for improved corrosion resistance.

During electroless plating, the metal ions in the plating bath are reduced on a catalytic surface by a reducing agent. Accordingly, the portions of a substrate to be plated generally must be of the same material, or exhibit an affinity for the plating metal or metal alloy. This is advantageous from the perspective that plating may occur at the same time on electrically isolated areas of the device being plated. This also allows selectivity to the deposition process. Such selective deposition is required for many of the operations performed during semiconductor fabrication.

In comparison to other deposition techniques, electroless plating is attractive due to the low processing cost and high quality of metal deposited. However, there are still challenges in the use and application of electroless plating in semiconductor fabrication. Electroless deposition requires an active surface on which to electrolessly deposit the metal. Additionally, electroless deposition requires complicated, multi-component chemistries that pose both control and replenishment challenges due to the many and varied components. Thus, it presents a challenge to keep process flows simple. Still another challenge is to provide a stable bath for plating to occur while meeting the complex chemical demands required to accomplish the plating process. Yet another challenge is to minimize or eliminate impurities in the plating bath solution that have an adverse effect on other components of semiconductor devices.

Accordingly, the need exists in the art for electroless plating bath compositions that provide stable, controllable metal deposition, and their use in the fabrication of structures in semiconductor devices.

SUMMARY OF THE INVENTION

The present invention meets that need by providing a cobalt electroless plating bath composition which is relatively inexpensive and simple to use and contains little or no impurities. In accordance with one aspect of the present invention, an electroless plating composition is provided and includes succinic acid, potassium carbonate, a source of cobalt metal ions, a reducing agent, and water. An optional buffering agent may also be used. In one embodiment, the buffering agent comprises ammonium sulfate and the reducing agent comprises dimethylamine borane.

In other embodiments, the composition may further include an additional chelating agent such as, for example, a diammonium salt of EDTA. In still other embodiments, the composition may further include a wetting agent such as, for example, polyethylene glycol methyl ether.

In another aspect of the invention, a process of forming a cobalt metal layer on a semiconductor device is provided and includes exposing a semiconductor device substrate to an electroless plating composition comprising succinic acid, potassium carbonate, a source of cobalt metal ions, a buffering agent, a reducing agent, and water, for a time sufficient to deposit said cobalt metal layer. In one embodiment, the buffering agent comprises ammonium sulfate and the reducing agent comprises dimethylamine borane. The composition may further include an additional chelating agent and/or a wetting agent.

In another embodiment, the process may include forming an opening in the substrate and depositing cobalt metal in the opening to substantially fill the opening. The opening may comprise a trench, via, or interconnect in the semiconductor device. In a further embodiment, the process may include depositing a metal cap on a conductive contact.

Accordingly, it is a feature of the several embodiments of the present invention to provide a cobalt electroless plating bath composition that provides stable, controllable metal deposition. It is an additional feature of the several embodiments of the invention to use such an electroless plating composition in the fabrication of structures in semiconductor devices. These and other features and advantages will become apparent from the following detailed description and appended claims.

DETAILED DESCRIPTION OF THE PREFERRED EMBODIMENTS

Electroless plating is a process by which a metal is deposited on a surface by chemical reduction in the absence of an external electric current. Electroless plating is a selective process and occurs at locations on a surface, or in a trench, via, or contact opening, that has nucleation potential for the plating solution. In one embodiment of the present invention, an electroless plating composition comprising succinic acid, potassium carbonate, a source of cobalt metal ions, a reducing agent, and water is provided. An optional buffering agent may also be used in the composition.

The plating composition may be used in a wide variety of electroless plating processes. For example, any surface or structure in a semiconductor device may provide a surface for electroless plating once that surface has been activated using procedures known in the art. Additionally, some surfaces are active and are receptive to electroless plating without the need to activate the surface. In one example, electroless plating may be carried out on a metallized surface of a contact pad. In another example, electroless plating may be used to fill a contact opening, trench, or via in a semiconductor structure. In yet another example, electroless plating may be used to form a metal cap over a recessed conductive metal plug, contact, or interconnect.

The electroless plating composition can use a number of different sources of cobalt. For example, cobalt sulfate, cobalt chloride, cobalt dinitrate, and cobalt sulfamate are all useful sources. Cobalt sulfate is a preferred source of cobalt as it is compatible with the other components of the preferred plating composition. The plating composition is provided as an aqueous solution. Preferably deionized water is used.

The use of reducing agents assures metal deposition by providing a source of electrons to the chemical environment adjacent the substrate onto which the metal is plated. A preferred reducing agent is one including boron (B). While both inorganic and organic reducing agents may be utilized, a preferred reducing agent for practicing embodiments of the present invention comprises a dimethylaminoborane (DMAB) complex. Other aminoboranes such as diethylaminoborane and morpholine borane may also be utilized. Other reducing agents may also be present in the plating composition.

Succinic acid provides an acidic environment for the plating composition. The addition of potassium carbonate adjusts the pH of the plating composition and provides a stable composition. Plating bath stability is a potential problem with any electroless plating bath. Problems develop as small particles precipitate or plate out of solution. As more material precipitates and forms larger particles, the particles may reach a size that the bath collapses.

Control of the pH of an electroless plating bath is important. The use of potassium carbonate provides improved pH control over other basic compounds such as hydroxides. In solution, succinic acid reacts with potassium carbonate with the release of carbon dioxide. Release of carbon dioxide gas drives the reaction to form potassium succinate to completion. The potassium succinate functions as a chelating agent in the plating bath composition. Both succinic acid and potassium carbonate are readily commercially available in purities exceeding 99% so that the resulting plating bath composition has little or no impurities.

The electroless plating composition also includes a buffering agent. A preferred buffering agent comprises ammonium sulfate. In other embodiments of the invention, the plating composition also includes an additional chelating agent and/or a wetting agent. A preferred additional chelating agent comprises the diammonium salt of ethylene diamine tetraacetic acid (EDTA). The use of an additional chelating agent helps to tie up free cobalt metal in the plating bath to reduce the activity of the plating composition while maintaining a high plating rate. A preferred wetting agent comprises a polyethylene glycol methyl ether such as, for example, PEG [2-[ethyl[(heptadecafluorooctyl)sulfonyl]amino]methyl ether. Wetting agents aid in facilitating high aspect ratio plating of trenches, contact openings, and interconnects and also may promote bottom-up plating in such high aspect ratio openings.

Generally, in a preferred embodiment, the plating composition comprises an aqueous solution containing from about 4.0 to about 25.0 gm/l succinic acid, from about 4.0 to about 20.0 gm/l potassium carbonate, from about 7.0 to about 30.0 gm/l cobalt sulfate, from about 4.0 to about 25.0 gm/l ammonium sulfate, and from about 0.5 to about 5.0 gm/l dimethylamine borane. In a specific embodiment, the plating composition comprises about 5.7 gm/l succinic acid, about 6.6 gm/l potassium carbonate, about 5.7 gm/l ammonium sulfate, about 6.25 gm/l cobalt sulfate, and about 1.5 gm/l dimethylamine borane.

When expressed as weight percentages, a preferred embodiment of the plating composition comprises from about 0.4 to about 2.5% succinic acid, from about 0.4 to about 2.0% potassium carbonate, from about 0.7 to about 3.0% cobalt sulfate, from about 0.4 to about 2.5% ammonium sulfate, from about 0.05 to about 0.5% dimethylamine borane, and the balance water, all percentages by weight.

In order that the invention may be more readily understood, reference is made to the following example which is intended to illustrate the invention, but not limit the scope thereof.

EXAMPLE

An electroless cobalt plating bath was prepared as follows. To 300 ml of deionized water, 1.70 g succinic acid and 2.1 g potassium carbonate were added. The resulting solution was heated to 50° C. and mixed for 5 minutes until the evolution of carbon dioxide gas ceased. Then, 1.7 g ammonium sulfate and 2.9 g cobalt sulfate were added with mixing for 5 minutes while maintaining the solution at 50° C. to permit the cobalt to form a complex. Then, 0.5 g of dimethyl amine borane was added to the solution. The resulting plating composition exhibited good plating results when plated onto chemical vapor deposited (CVD) tungsten.

Preferably, the electroless plating process is run with a bath temperature of approximately 70° C. to achieve a high plating rate. To improve the stability of the plating bath when operating at such a temperature, from about 0.1 to about 0.5 g of EDTA ammonium salt was added to the bath. The EDTA ammonium salt chelating agent reduced the activity of the bath while maintaining the high plating rate. In addition, 0.1 ml of a 0.1% solution of PEG [2-[ethyl[(heptadecafluorooctyl)sulfonyl]amino]methyl ether was added to the bath. This surfactant helps to facilitate plating of high aspect ratio openings (e.g., trenches, contact openings, and interconnects) and to promote bottom up plating of cobalt in such openings.

It will be apparent to those skilled in the art that various changes may be made without departing from the scope of the invention which is not considered limited to what is described in the specification.

What is claimed is:

1. A process of forming a cobalt metal layer on a semiconductor device comprising exposing a semiconductor device substrate to an electroless plating composition comprising succinic acid, potassium carbonate, a source of cobalt metal ions, a reducing agent, a wetting agent comprising polyethylene glycol methyl ether, and water, for a time sufficient to deposit said cobalt metal layer.

2. A process as claimed in claim 1 in which said electroless plating composition further comprises a buffering agent.

3. A process as claimed in claim 2 in which said buffering agent comprises ammonium sulfate.

4. A process as claimed in claim 1 in which said reducing agent comprises dimethylamine borane.

5. A process as claimed in claim 1 wherein said electroless plating composition further includes an additional chelating agent.

6. A process as claimed in claim 5 wherein said additional chelating agent comprises a diammonium salt of EDTA.

7. A process as claimed in claim 1 including forming an opening in said substrate and depositing cobalt metal in said opening.

8. A process as claimed in claim 7 including substantially filling said opening with cobalt metal.

9. A process of forming a cobalt metal layer on a semiconductor device comprising exposing a semiconductor device substrate to an electroless plating composition comprising an aqueous solution containing from about 4.0 to about 25.0 gm/l succinic acid, from about 4.0 to about 20.0 gm/l potassium carbonate, from about 7.0 to about 30.0 gm/l cobalt sulfate, from about 4.0 to about 25.0 gm/l ammonium sulfate, a wetting agent comprising polyethylene glycol methyl ether, and from about 0.5 to about 5.0 gm/l dimethylamine borane, for a time sufficient to deposit said cobalt metal layer.

10. A process as claimed in claim 9 in which said electroless plating composition comprises about 5.7 gm/l succinic acid, about 6.6 gm/l potassium carbonate, about 5.7 gm/l ammonium sulfate, about 6.25 gm/l cobalt sulfate, and about 1.5 gm/l dimethylamine borane.

11. A process of forming a cobalt metal layer on a semiconductor device comprising exposing a semiconductor device substrate to an electroless plating composition comprising from about 0.4 to about 2.5% succinic acid, from about 0.4 to about 2.0% potassium carbonate, from about 0.7 to about 3.0% cobalt sulfate, from about 0.4 to about 2.5% ammonium sulfate, a wetting agent comprising polyethylene glycol methyl ether, from about 0.05 to about 0.5% dimethylamine borane, and the balance water, all percentages by weight for a time sufficient to deposit said cobalt metal layer.

12. A process as claimed in claim 11 wherein said electroless plating composition further includes an additional chelating agent.

13. A process as claimed in claim 12 wherein said additional chelating agent comprises a diammonium salt of EDTA.

14. A process as claimed in claim 11 including forming an opening in said substrate and depositing cobalt metal in said opening.

15. A process as claimed in claim 14 in which said cobalt metal substantially fills said opening.

16. A process as claimed in claim 1 comprising depositing said cobalt metal layer on a metalized surface of a contact pad.

17. A process as claimed in claim 1 comprising depositing said cobalt metal layer and forming there-from a metal cap over a recessed conductive metal plug.

18. A process as claimed in claim 1 comprising depositing said cobalt metal layer and forming an interconnect therefrom.

19. A process of forming a cobalt metal layer on a semiconductor device comprising exposing a semiconductor device substrate to an electroless plating composition consisting essentially of potassium succinate, a source of cobalt metal ions, an aminoborane reducing agent, and water, for a time sufficient to deposit said cobalt metal layer.

20. A process as claimed in claim 19 comprising forming the potassium succinate from a reaction of succinic acid and potassium carbonate.

* * * * *